US008309016B2

(12) United States Patent
König et al.

(10) Patent No.: US 8,309,016 B2
(45) Date of Patent: Nov. 13, 2012

(54) SHAFT FURNACE AND METHOD FOR OPERATING A FURNACE

(75) Inventors: Gerd König, Dinslaken (DE); Wolfram König, Ibbenburen (DE); Alexander Babich, Aachen (DE); Dieter Georg Senk, Aachen (DE); Heinrich-Wilhelm Gudenau, Aachen (DE); Hans-Heinrich Heldt, Viersen (DE)

(73) Assignee: Thyssenkrupp AT.PRO Tec GmbH, Essen (DE)

( * ) Notice: Subject to any disclaimer, the term of this patent is extended or adjusted under 35 U.S.C. 154(b) by 55 days.

(21) Appl. No.: 12/666,587

(22) PCT Filed: Jun. 17, 2008

(86) PCT No.: PCT/EP2008/057624

§ 371 (c)(1),
(2), (4) Date: May 26, 2010

(87) PCT Pub. No.: WO2009/000704

PCT Pub. Date: Dec. 31, 2008

(65) Prior Publication Data

US 2010/0251855 A1 Oct. 7, 2010

(30) Foreign Application Priority Data

Jun. 26, 2007 (DE) ..... 10 2007 029 629

(51) Int. Cl.
*C21B 13/02* (2006.01)

(52) U.S. Cl. ..... 266/47; 266/44; 266/197

(58) Field of Classification Search ..... 266/44, 266/47, 197

See application file for complete search history.

(56) References Cited

U.S. PATENT DOCUMENTS

| | | | | |
|---|---|---|---|---|
| 4,374,585 | A * | 2/1983 | Papst et al. | 266/81 |
| 4,390,346 | A * | 6/1983 | Cramer et al. | 48/180.1 |
| 2007/0137436 | A1 | 6/2007 | Loffler | |
| 2008/0237944 | A1 | 10/2008 | Konig et al. | |

FOREIGN PATENT DOCUMENTS

| | | | |
|---|---|---|---|
| GB | 950071 | A | 2/1964 |
| GB | 1247417 | A | 9/1971 |
| WO | 01/36891 | A | 5/2001 |

OTHER PUBLICATIONS

Abstract of WO01/36891; May 25, 2001.
International Search Report, PCT/EP2008/057624, dated Jan. 19, 2009, 6 pages.

(Continued)

*Primary Examiner* — Scott Kastler
(74) *Attorney, Agent, or Firm* — Senniger Powers LLP

(57) ABSTRACT

The present invention relates to a shaft furnace as well as a method for operating a shaft furnace. For example, the present invention relates to methods for operating a shaft furnace which include charging an upper region of the shaft furnace with raw materials; the raw materials sink in the shaft furnace under the influence of gravity and a part of the raw materials is smelted an/or at least partially reduced under the effect of the atmosphere prevailing within the shaft furnace. The methods further comprise admitting an addition gas via at least one addition opening spaced from a lower admission opening and/or discharging a shaft furnace gas via a shaft furnace gas line to provide discharge of gaseous reaction products from the interior of the shaft furnace.

29 Claims, 2 Drawing Sheets

OTHER PUBLICATIONS

Written Opinion, PCT/EP2008/057624, dated Jan. 19, 2009, 7 pages.
International Preliminary Report on Patentability, PCT/EP2008/057624, dated Jan. 21, 2010, 10 pages.
Donskov et al., "Investigation of blast furnace operation with imposed pulsations in top pressure", Steel in the USSR, vol. 6, No. 2, 1976, pp. 55-57.

* cited by examiner

SHAFT FURNACE AND METHOD FOR OPERATING A FURNACE

REFERENCE TO RELATED APPLICATIONS

This application claims priority to German Application 10 2007 029 629.2 filed Jun. 26, 2007.

FIELD OF INVENTION

The invention relates to a shaft furnace as well as a method for operating a shaft furnace which for example can be employed as blast furnace, cupola furnace, imperial smelter or waste incineration furnace.

BACKGROUND

For the production of primary melt of iron, a shaft furnace configured as blast furnace is predominantly employed as main unit, while other methods merely have a corresponding share of only approximately 5%. This shaft furnace can operate according to the counterflow principle. Raw materials such as burden and coke are charged in the upper region of the shaft furnace of the furnace top and sink to the bottom in the shaft furnace. In a lower region of the furnace (blow mould level) a treatment gas (so-called blast air with a volume of 800-1 100 $m^3$/tRE depending on the size of the furnace) is blown into the furnace through blow moulds. In the process, the hot blast, which usually is air heated in advance in blast preheaters to approximately 1 000 to 1300° C., reacts with the coke during which carbon monoxide is generated among other things. The carbon monoxide rises in the furnace and reduces the iron oxides and additional iron compounds contained in the burden.

In addition to this, substitute reduction agents with for example 100-200 kg/tRE (coal dust, oil, natural gas or plastic) are usually also blown into the furnace which promotes the generation of reduction gas.

In addition to the reduction of the iron ores the raw materials melt because of the heat generated by the chemical processes that occur in the shaft furnace. The gas distribution over the cross section of the shaft furnace however is irregular. For example in the centre of the shaft furnace the so-called "dead man" is formed while the relevant processes such as gasification (reaction of oxygen with coke or substitute reduction agents to form carbon monoxide and carbon dioxide) merely occurs in the so-called fluidised zone, which is a region in front of a blow mould, i.e. with respect to the cross section of the furnace is only located in a marginal region. The fluidised zone has a depth towards the furnace centre of approximately 1 m and a volume of approximately 1.5 $m^3$. Usually a plurality of blow moulds are circumferentially arranged in the blow mould level in such a manner that the fluidised zone formed in front of each blow mould overlaps with the fluidised zones formed on the left and right or is located closely together, so that the active region is substantially provided by a circular region. The so-called "raceway" or fluidised zone forms during the operation of the shaft furnace.

Furthermore, the hot blast can usually be enriched with oxygen in order to intensify the processes (gasification in the fluidised zone, reduction of the iron ores) just described, which results in an increase of the performance of the shaft furnace. Here, the hot blast can for example be enriched with oxygen before feeding in, or pure oxygen can also be fed in separately, wherein for the separate feeding a so-called lance has to be provided, i.e. a pipe which extends for example within the blow mould, which itself is a pipe-like part, and terminates within the blow mould in the furnace. More preferably with modern blast furnaces, which are operated with low coke rate, the hot blast is suitably enriched with oxygen to a high degree. On the other hand the production costs are increased through the addition of oxygen so that the efficiency of a modern shaft furnace cannot simply be increased by corresponding addition of ever more increased oxygen concentration.

It is also known that the efficiency of a modern shaft furnace is correlated with the so-called through-gasification in the shaft furnace. Generally this means how well the gasification in the fluidised zone, the reduction of the iron ores and generally the draught of the gas phase prevailing in the shaft furnace operates from the blow mould level up to the top, where the so-called blast furnace gas is discharged. A sign of better through-gasification for example is the least loss of pressure possible in the furnace.

From WO 2007/054308 A2 it is known to operate a suitably configured shaft furnace in such a manner that the treatment gas introduced in the lower region of the blast furnace is pulsed at short time intervals. The pressure and/or the volumetric flow of the treatment gas are varied within a time span of less than 40 s, as a result of which the through-gasification of the shaft furnace and thus the efficiency of the shaft furnace are improved. Furthermore, the treatment gas before the introduction can be branched off with different pressures to the various blow moulds in the blow mould level in order to be able to set different peripheral conditions in different sectors of the blow mould level.

However there exists a continuous need for further improving the efficiency of the shaft furnace.

SUMMARY OF THE INVENTION

It is the object of the invention to create a method and a shaft furnace with improved efficiency.

According to the invention, the object is solved through a method with the features of claim 1 and a shaft furnace with the features of claim 9. Advantageous configurations of the invention are stated in the subclaims.

With the method according to the invention for operating a shaft furnace an upper region of the shaft furnace is charged with raw materials which under the effect of gravity sink in the shaft furnace. A part of the raw materials is smelted under the effect of the atmosphere prevailing within the shaft furnace and/or at least partially reduced. In a lower region of the shaft furnace a treatment gas is introduced via at least one lower admission opening, which gas at least partially influences the atmosphere prevailing within the shaft furnace. The introduction of the lower treatment gas is modulated dynamically in such a manner that with the modulation the operating variables pressure $p_1$ and/or volumetric flow $\dot{V}_1$ at least at times are varied within the time span of $\leqq$40 s, more preferably $\leqq$20 s, preferably $\leqq$5 s and particularly preferably $\leqq$1 s. According to the invention, an addition gas is introduced via at least one addition opening spaced from the lower admission opening whose operating variables pressure $p_2$ and/or volumetric flow $\dot{V}_2$ are varied at least at times, and/or via a shaft furnace gas line for the discharge of gaseous reaction products connected with the interior of the shaft furnace a shaft furnace gas is discharged whose operating variables pressure $p_3$ and/or volumetric flow $\dot{V}_3$ are varied at least at times. The variation of the operating variables of the addition gas and/or the blast furnace gas according to the invention is performed in such a manner that in the interior of the shaft furnace the pressure $p_1$ and/or the volumetric flow $\dot{V}_1$ increases at least partially. For example the pressures $p_1$ and $p_2$ and/or the volumetric flows $\dot{V}_1$ and $\dot{V}_2$, can at least partially add up within the shaft furnace. More preferably the components of the pressure curve of the pressures $p_1$ and $p_2$ and/or the volumetric flow curve of the volumetric flows $\dot{V}_1$ and $\dot{V}_2$, which are above an average mean value and/or basic value are added up. Accordingly, if for example the shaft furnace gas line is at least partially closed, a part of the otherwise discharged volumetric flow $V_3$ or a part of the pressure $p_3$ applied through the backing up of the blast furnace gas can be added to the pressure $p_1$ and/or volumetric flow $\dot{V}_1$ prevailing in the interior of the shaft furnace.

It has been shown that through the additional variation of the pressure and/or the volumetric flow in part regions of the shaft furnace an additional increase of the pressure and/or volumetric flow takes place, which leads to improved efficiency of the shaft furnace. It is assumed that the dwell time of the treatment gas is increased as a result of which the efficiency of the shaft furnace can be improved. An improvement of the efficiency can thus be already achieved if addition of the pressures and/or volumetric flows takes place merely for a short time and with a large time interval. The introduction of the addition gas and/or the discharge of the shaft furnace gas is preferred dynamically modulated in such a manner that during the modulation the operating variables pressure $p_2$ and/or volumetric flow $\dot{V}_2$, of pressure $p_3$ and/or volumetric flow $\dot{V}_3$ are varied at least at times within the time span of $\leqq 40$ s, more preferably $\leqq 20$ s, preferred $\leqq 5$ s and particularly preferred $\leqq 1$ s. As a result the pressure and/or volumetric flow increases occur particularly frequently and at short time intervals so that the efficiency of the shaft furnace can be particularly greatly improved.

Preferentially the amplitude of the pressure $p_1$ and/or $p_2$ and/or $p_3$ and/or the volumetric flows $\dot{V}_1$ and/or $\dot{V}_2$, and/or $\dot{V}_3$ based on the mean value amounts to 10%-1 000%, more preferably 10%-400%, preferentially 10%-200% and particularly preferred 10%-100%. Such changes of the amplitude of the pressure and/or volumetric flow curve are already sufficient for a significant improvement of the efficiency of the shaft furnace without exceeding type-related permissible maximum values.

Particularly preferred the pressures $p_1$ and/or $p_2$ and/or $p_3$ and/or the volumetric flow $\dot{V}_1$ and/or $\dot{V}_2$, and/or $\dot{V}_3$ are varied in such a manner that within the shaft furnace a superimposed oscillation with a phase difference $\phi$ of $-/2 \leqq \phi \leqq /2$, more preferably $-/4 \leqq \phi \leqq /4$ and preferentially $\phi = 0 \pm /90$ develops. Here, particularly the velocity of the flowing gas in this phase relationship can be taken into account via a mean dwell time of the gas in the shaft furnace (usually 3 to 20 s) to be determined experimentally so that in the interior of the shaft furnace the desired phase difference is obtained. The increase of the amplitude of the pressure and/or volumetric flow curves becomes particularly intense as a result and mutual deletion of the operating quantity fluctuations is avoided.

Preferentially the modulation of the treatment gas and/or the addition gas and/or the shaft furnace gas occurs quasi-periodically, more preferably periodically, preferentially harmonically, wherein for the period duration T $40\text{ s} \geqq T \geqq 60$ ms, more preferably $20\text{ s} \geqq T \geqq 100$ ms preferentially $10\text{ s} \geqq T \geqq 0.5$ s and particularly preferred $5\text{ s} \geqq T \geqq 0.7$ s applies. This can be achieved through simple sinusoidal modulation $f(t) = f_0 + \Delta f \sin(2t/T + \phi)$. This facilitates generating and superimposing the pressure and/or volumetric flow oscillations.

Furthermore, the modulations of the treatment gas and/or the addition gas and/or the shaft furnace gas can more preferably take place in a pulsating manner wherein for a pulse width a of a pulse $5\text{ s} \geqq \sigma \geqq 1$ ms more preferably $0.7\text{ s} \geqq \sigma \geqq 25$ ms, preferred $0.1\text{ s} \geqq \sigma \geqq 30$ ms and particularly preferred $55\text{ ms} \geqq \sigma \geqq 35$ ms applies. Such a modulation is for example characterized by a function $f(t) = f_0 + \Sigma i\ \delta(t - t_i)$, wherein $\delta(t)$ generally describes a pulse, i.e. recurring pulse peaks with respect to a substantially constant background. The pulses themselves can be rectangular pulses, triangular pulses, Gaussian pulses (processed mathematical $\delta$ pulse) or similar pulse shapes, wherein more preferably the pulse width $\delta$ is important, which is the pulse width with half pulse height. In a preferred method configuration the periodic pulsations have a ratio pulse width $\delta$ to period duration T of $10^{-4} \leqq \delta/T \leqq 0.5$, preferred $10^{-3} \leqq \delta/T \leqq 0.2$, more preferably $10^{-2} \leqq \delta/T \leqq 0.1$. The pressure and/or volumetric flow change occurs particularly suddenly as a result so that (quasi) stationary flows which could lead to stream formations with minor mixing-through are avoided. Furthermore one succeeds with influencing processes which take place in the shaft furnace with correspondingly minor reaction times.

In a preferred embodiment the increase of the pressure and/or volumetric flow peaks occurs not only in respect of time but also in respect of space. Preferentially, the following applies to a distance d between the lower admission opening and the addition opening based on a height h between the lower admission opening and an upper outlet opening $0.1 \leqq d/h \leqq 1.0$, more preferably $0.25 \leqq d/h \leqq 1.0$, preferentially $0.5 \leqq d/h \leqq 1.0$, particularly preferred $0.75 \leqq d/h \leqq 1.0$ and further preferred $0.9 \leqq d/h \leqq 1.0$. A measurable improvement of the efficiency of the shaft furnace manifests itself even with comparatively small spacings of the lower admission opening from the addition opening. A greater efficiency improvement is obtained however if the spacings are greater since pressure losses can be better offset via the height of the shaft furnace without exceeding a permissible maximum pressure. Particularly, a plurality, that is two or more addition openings can be arranged at different heights of the shaft furnace, wherein the height spacings between the openings can be the same in each case. Through the even distribution of the openings over the height of the shaft furnace the superimpositions of the pressure and/or volumetric flow oscillations can be particularly easily set and occurring pressure losses offset.

In a preferred embodiment an immersion line is provided which is immersed in the interior of the shaft furnace and forms the addition opening at a defined height of the shaft furnace. As a result it is possible to blow in gas both from the outside as well as from the inside whose pressure and/or volumetric flow changes can be superimposed.

Particularly it is possible that the addition gas comprises treatment gas and/or more preferably shaft furnace gas exiting at an upper end of the shaft furnace. To this end, an upper outlet opening of the shaft furnace is more preferably connected with the addition opening via the shaft furnace gas line to return shaft furnace gases. In addition, the reduction in the upper region of the shaft furnace can also be improved through fed-in treatment gas. Particularly the atmospheric conditions in the interior of the shaft furnace can be individually modified through a suitable choice of the shaft furnace gas and/or treatment gas quantities. By means of this the atmosphere, in the case of operating faults, can be subsequently optimised and adapted to changing peripheral conditions.

The invention furthermore relates to a shaft furnace, particularly blast furnace, cupola furnace, imperial smelter or waste incineration furnace which comprises a device for the charging of an upper region of the blast furnace with raw materials and at least a lower admission opening for admitting a treatment gas in a lower region of the shaft furnace, in order to smelt and/or at least partially reduce a part of the raw materials under the effect of the atmosphere prevailing within the shaft furnace. Furthermore, a control device is provided which is set in such a manner that the operating variables pressure $p_1$ and/or volumetric flow $\dot{V}_1$ of the treatment gas are subjected to a variation within the time span of ≦40 s, more preferably ≦20 s, preferred ≦5 s and particularly preferred ≦1 s. According to the invention, at least one addition opening spaced from the lower admission opening is provided for admitting addition gas, wherein an additional control device is provided which is set in such a manner that the operating variables pressure $p_2$ and/or volumetric flow $\dot{V}_2$, of the addition gas are varied at least at times and/or a shaft furnace gas line connected with the interior of the shaft furnace is provided for the discharge of gaseous reaction products, wherein a shaft furnace control device is provided, which is set in such a manner that the operating variables pressure $p_3$ and/or volumetric flow $\dot{V}_3$ of the shaft furnace gas are varied at least at times. The variation of the operating variables of the addition gas and/or the shaft furnace gas according to the invention takes place in that in the interior of the shaft furnace the pressure $p_1$ and/or the volumetric flow $\dot{V}_1$ at least partially increases. The shaft furnace is more preferably suitable for the method described above. Preferentially the shaft furnace is embodied and further developed as explained above by means of the method.

Since with the help of the control devices the pressure and/or volumetric flow changes of the admitted gases in the interior of the shaft furnace can be superimposed on one another in such a manner that the pressure and/or the volumetric flow in the interior of the shaft furnace are at least partially added up, an improvement of the efficiency of the shaft furnace is achieved. It is assumed that through the pressure and/or volumetric flow peaks the movement of the treatment gas comprises enlarged components of a zigzag movement, as a result of which the through-gasification is improved. The result of this is that the treatment gas can react more completely so that more material can be smelted and/or reduced with less treatment gas.

BRIEF DESCRIPTION OF THE FIGURES

The invention is explained in the following in more detail by means of preferred exemplary embodiments.

It shows.

DETAILED DESCRIPTION OF PREFERRED EMBODIMENTS

Figure 1:
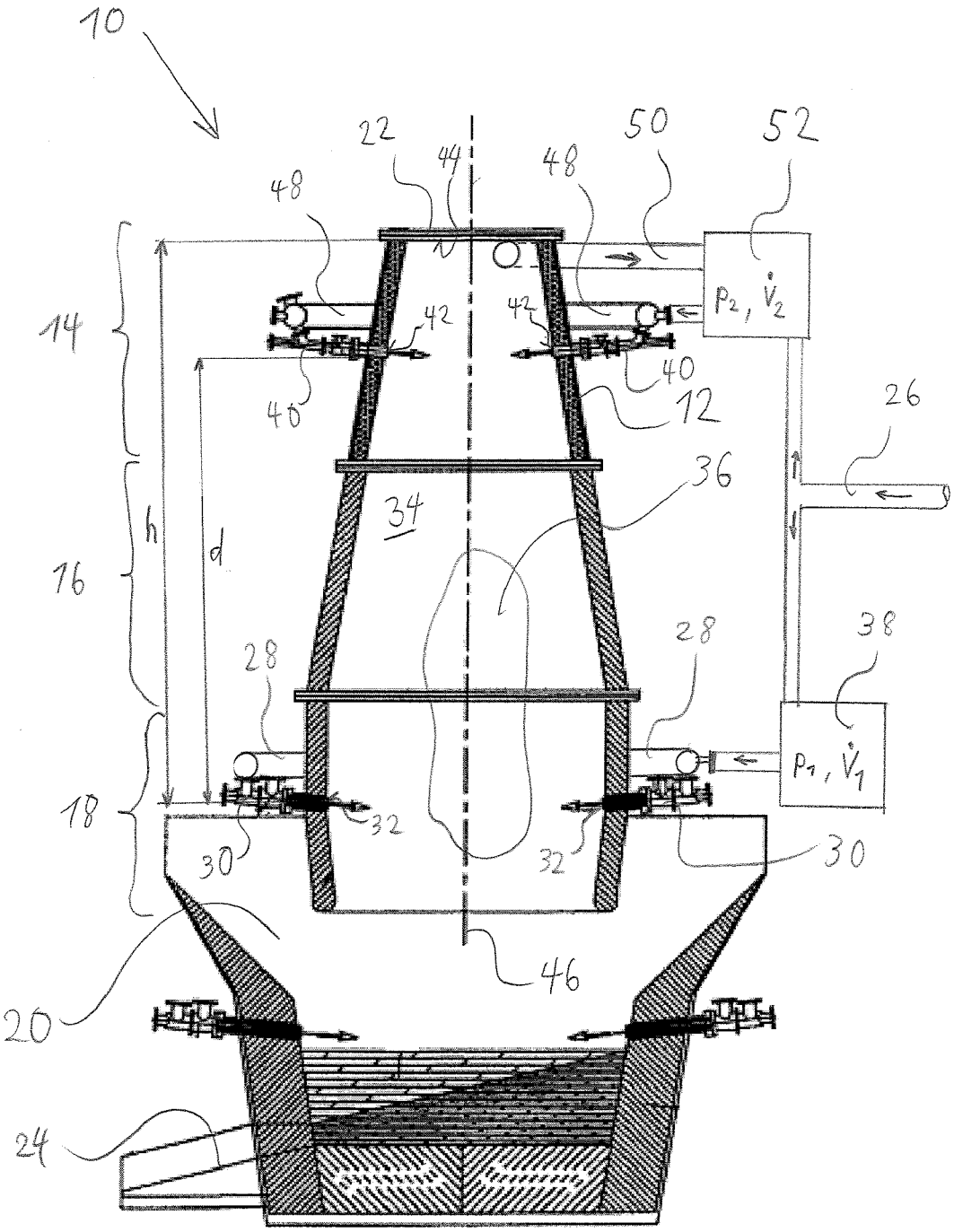
FIG. 1: a schematic lateral view of a shaft furnace according to the invention

The shaft furnace 10 shown in FIG. 1 comprises a substantially tubular shaft furnace body 12 which can be roughly subdivided into an upper third 14, a middle third 16 and a lower third 18. The lower third 18 is followed by a sump 20 which accommodates and discharges via a drain 24 in the molten state the material added into the upper third 14 via a flap 22.

Via a feed line 26 treatment gas is directed to lower nozzles 30 via a lower ring line 28 connected in-between, which nozzles 30 introduce the dynamically modulated treatment gas into the interior 34 of the shaft reactor 10 via a lower admission opening 32. Near the admission openings 32 a reaction zone described as "raceway" or fluidised zone is formed which encloses a zone of low reactivity in the lower region described as "dead man" 36. Between the feed line 26 and the admission opening 32 a control device 38 is connected, which is set in such a manner that the operating variables pressure $p_1$ and/or volumetric flow $\dot{V}_1$ of the treatment gas within a time span of ≦40 s, more preferably ≦20 s, preferred ≦5 s and particularly preferred ≦1 s are subjected to a variation. The control device 38 can function comparably to a particularly rapidly operating bellows.

Comparable with the admission of the treatment gas in the lower third 18, addition gas can be fed into the middle third 16 and/or into the upper third 14 in order to achieve addition of the pressures $p_1$ and $p_2$ and/or the volumetric flows $\dot{V}_1$ and $\dot{V}_2$, at least partially in the interior 34 of the shaft furnace 10 through a variation of the operating variables pressure $p_2$ and/or volumetric flow $\dot{V}_2$, Through the achievable pressure and/or volumetric flow peaks the dead man 36 can be clearly reduced as a result of which the efficiency of the shaft furnace 10 is improved.

In the shown exemplary embodiment the addition gas is admitted into the interior 34 of the shaft furnace 10 dynamically modulated via addition openings 42. The distance d of the addition openings 42 to the lower admission openings 32 in the exemplary embodiment shown substantially amounts to approximately 80% of the spacing h between the lower admission opening 32 and an upper outlet opening 44 of the shaft furnace 10 that can be closed by the flap 22. The shaft furnace body 12 can particularly be configured substantially rotation-symmetrically to an axis of symmetry 46.

In the exemplary embodiment shown the upper nozzles 42 are connected with the feed line 26 via an upper ring line 48 so that as addition gas, treatment gas can be used or at least admixed. Furthermore, via a shaft furnace gas line 50, terminating in the region of the upper outlet opening 44, shaft furnace gas can be at least admixed to the addition gas. Between the feed line 26 and the shaft furnace gas line 50 and the addition opening 42 an additional control device 52 is provided which is set in such a manner that the operating variables pressure $p_2$ and/or volumetric flow $\dot{V}_2$, of the addition gas are varied at least at times in such a manner that in the interior 34 of the shaft furnace 10 the pressures $p_1$ and $p_2$ and/or the volumetric flow $\dot{V}_1$ and $\dot{V}_2$, are added up at least partially. Furthermore, non-return valves which are not shown can be provided which for example prevent a bypass flow from the lower region 18 into the upper region 14 past the shaft furnace body 12.

Figure 2:
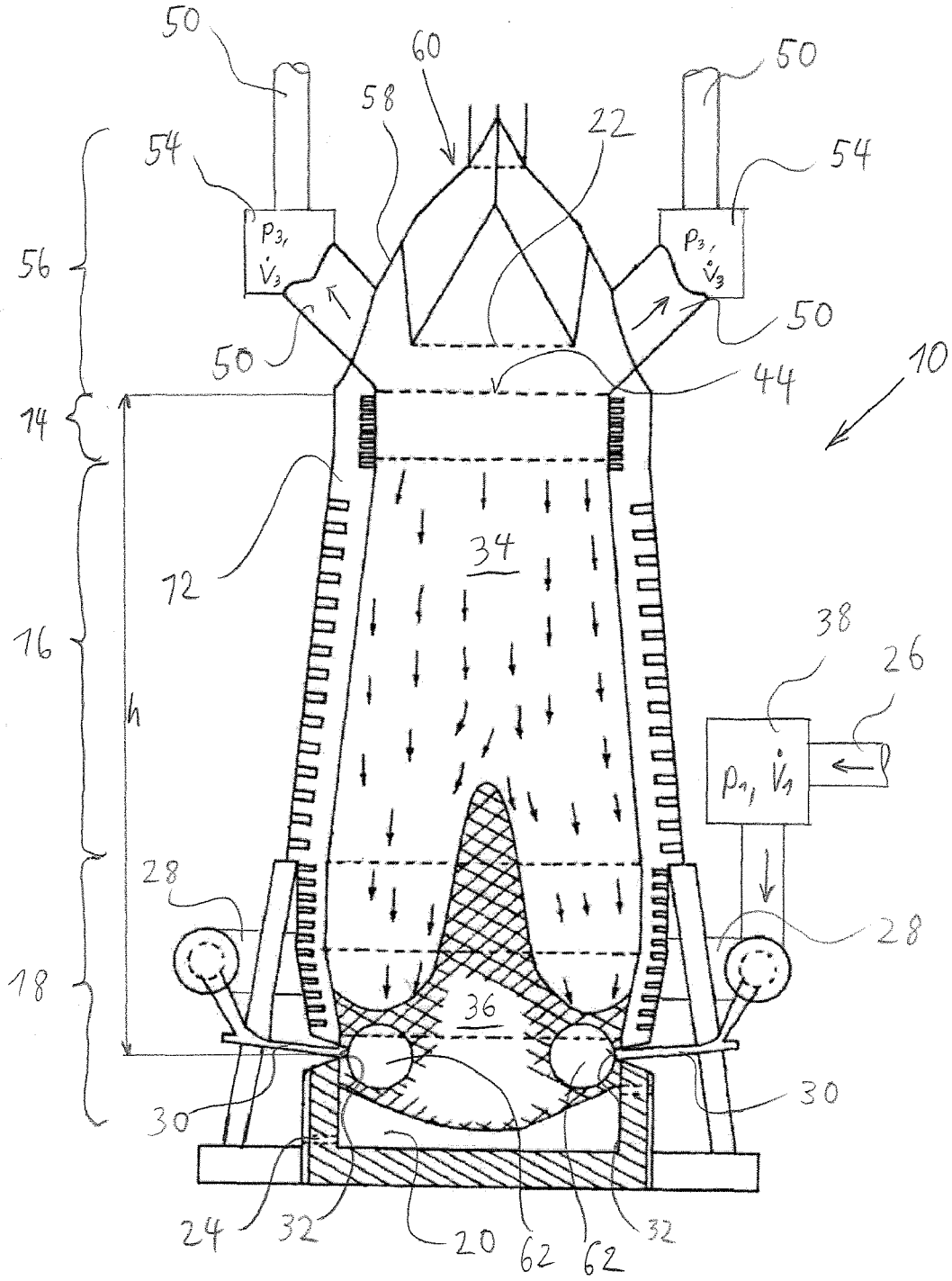
FIG. 2: a schematic lateral view of a shaft furnace according to the invention in a further embodiment.

With the shaft furnace 10 shown in FIG. 2 the superimposition of the pressure and/or volumetric flow changes, in contrast with the shaft furnace 10 shown in FIG. 1, is achieved with the help of shaft furnace gas instead of addition gas. To this end, the at least one shaft furnace gas line 50, which in the exemplary embodiment shown is provided more than once in order to divide the volumetric flow to be discharged comprises one shaft furnace control device 54 each, in order to at least at times vary the operating variables pressure $p_3$ and/or volumetric flow $V_3$ prevailing in the shaft furnace gas line 50 or just before the shaft furnace gas line 50 in such a manner that in the interior 34 of the shaft furnace 10 the pressure $p_1$ and/or the volumetric flow $\dot{V}_1$ are at least partially increased. To this end, the shaft furnace control device can briefly close at least partially the shaft furnace gas line 50 for example with the help of throttle valves so that an increasing static pressure is obtained, which can be removed again through subsequent opening of the shaft furnace gas line 50 before a permissible total pressure is exceeded.

In the shown exemplary embodiment the shaft furnace gas is discharged overhead, i.e. above the upper outlet opening 44 of the shaft furnace body 12 into the shaft furnace gas lines 50. To this end, a hood 58 is connected in an overhead region 56 with the shaft furnace body 12 with which the shaft furnace gas lines 50 are connected. The hood 58 additionally comprises a charging device 60 that can be closed with the flap 22, via which the raw materials are fed into the interior 34 of the shaft furnace 10 in order to sink down in the interior 34 of the shaft furnace 10. Through the treatment gas fed in via the nozzles 30 a reaction zone 62 substantially ring shaped designated as "raceway" is obtained which is arranged round about the dead man 36.

Particularly preferred the embodiments shown in FIG. 1 and FIG. 2 are combined with each other so that both the fed-in addition gas as well as the discharged shaft furnace gas are dynamically modulated in order to at least at times achieve an at least partial increase of the pressure and/or the volumetric flow in the interior 34 of the shaft furnace through superimposition of the pressure and/or volumetric flow oscillations. In addition, the already modulated shaft furnace gas can be supplied to the addition gas as a result of which additional superimposed oscillations are obtained which can likewise build up resonance-like in order to induce additional pressure and/or volumetric flow peaks.

The invention claimed is:

1. A method for operating a shaft furnace, the method comprising:

charging an upper region of the shaft furnace with raw materials, wherein the raw materials sink in the shaft furnace under the influence of gravity and a part of the raw materials is smelted and/or at least partially reduced under the effect of the atmosphere prevailing within the shaft furnace;

admitting a treatment gas into a lower region of the shaft furnace via at least one lower admission opening, wherein admission of the treatment gas influences the atmosphere prevailing within the shaft furnace; and modulating the admission of the treatment gas, wherein modulating admission of the treatment gas comprises varying the treatment gas pressure and/or treatment gas volumetric flow over a span of time of less than or equal to 40 seconds;

the method further comprising performing an operation selected from the group consisting of (a), (b), and (c):

(a) admitting an addition gas via at least one addition opening spaced from the lower admission opening, wherein the addition gas pressure and/or addition gas volumetric flow are varied such that the treatment gas pressure and/or the treatment gas volumetric flow in the interior of the shaft furnace are increased;

(b) discharging a shaft furnace gas via a shaft furnace gas line thereby providing discharge of gaseous reaction products from the interior of the shaft furnace, wherein the discharge gas pressure and/or discharge gas volumetric flow of the shaft furnace gas are varied such that the treatment gas pressure and/or the treatment gas volumetric flow in the interior of the shaft furnace are increased;

(c) (a) and (b).

2. The method according to claim 1, wherein the admission of the addition gas and/or the discharge of the shaft furnace gas is modulated such that the addition gas pressure, addition gas volumetric flow, discharge gas pressure and/or discharge gas volumetric flow are varied over a time span of less than or equal to 40 seconds.

3. The method according to claim 1, wherein the method affirmatively requires the operation (a) and the ratio of the distance (d) between the at least one lower admission opening and the at least one addition opening and the height (h) between the at least one lower admission opening and an upper outlet opening of the shaft furnace is from about 0.1 to about 1.0.

4. The method according to claim 1, wherein modulation of the treatment gas, modulation of the addition gas, and/or modulation of the shaft furnace gas is conducted in a manner selected from the group consisting of quasi-periodically, periodically, and harmonically for a period of time of from about 60 milliseconds to about 40 seconds.

5. The method according to claim 1, wherein modulation of the treatment gas, modulation of the addition gas, and/or modulation of the shaft furnace gas is conducted in a pulsating manner at a pulse width ($\sigma$) of from about 1 millisecond (ms) to about 5 seconds.

6. The method according to claim 1, wherein the treatment gas pressure, addition gas pressure, shaft furnace gas pressure, treatment gas volumetric flow, addition gas volumetric flow, and/or shaft furnace gas volumetric flow are varied such that within the shaft furnace there is a superimposed oscillation having a phase difference $\phi$ of $-/2 \leqq \phi \leqq /2$.

7. The method according to claim 1, wherein the method affirmatively requires the operation (a) and the addition gas comprises treatment gas and/or a shaft furnace gas exiting at an upper end of the shaft furnace.

8. The method according to claim 1, wherein the mean value of the amplitude of the treatment gas pressure, addition gas pressure, shaft furnace gas pressure, treatment gas volumetric flow, addition gas volumetric flow, and/or shaft furnace gas volumetric flow is from 10%-1000%.

9. A shaft furnace comprising:

an inlet for charging an upper region of the shaft furnace with raw materials;

at least one lower admission opening for admitting a treatment gas in a lower region of the shaft furnace in order to smelt and/or at least partially reduce a part of the raw materials under the effect of the atmosphere prevailing within the shaft furnace;

a controller which is set in such a manner that the treatment gas pressure and/or treatment gas volumetric flow are subjected to a variation over a span of time of less than or equal to 40 seconds;

the furnace further comprising a component selected from the group consisting of (a), (b), and (c):

(a) at least one addition opening spaced from the lower admission opening for the admission of an addition gas, and an addition controller which is set in such a manner that the addition gas pressure and/or addition gas volumetric flow of the addition gas are varied in such a manner that the treatment gas pressure and/or the treatment gas volumetric flow in the interior of the shaft furnace increase;

(b) a shaft furnace gas line for the discharge of gaseous reaction products from the interior of the shaft furnace, and a shaft furnace controller which is set in such a manner that the shaft furnace pressure and/or shaft furnace volumetric flow of the shaft furnace gas are varied in such a manner that in the interior of the shaft furnace the treatment gas pressure and/or treatment gas volumetric flow are increased;

(c) (a) and (b).

10. The shaft furnace according to claim 9, wherein the furnace affirmatively requires the component (a) and comprises a spacing (d) between the at least one lower admission opening and the addition opening and a height (h) between the at least one lower admission opening and an upper outlet opening of the shaft furnace, wherein the ratio of d:h is from about 0.1 to about 1.0.

11. The shaft furnace according to claim 9, wherein the furnace affirmatively requires component (a) and component (b) and comprises an upper outlet opening of the shaft furnace which is connected with the addition opening via the shaft furnace gas line for returning shaft furnace gas.

12. The shaft furnace according to claim 9, comprising an immersion pipe which is immersed in the interior of the shaft furnace and at a defined height of the shaft furnace forms the addition opening.

13. The method according to claim 1, wherein the method affirmatively requires the operation (a) and the at least one addition opening is spaced in a vertical direction from the at least one lower admission opening.

14. The shaft furnace according to claim 9, wherein the furnace affirmatively requires the component (a) and the at least one addition opening is spaced in a vertical direction from the at least one lower admission opening.

15. The method according to claim 1, wherein the method affirmatively requires the operation (b) and the shaft furnace gas line is spaced in a vertical direction from the at least one lower admission opening.

16. The shaft furnace according to claim 9, wherein the furnace affirmatively requires the component (b) and the shaft furnace gas line is spaced in vertical direction from the at least one lower admission opening.

17. The method according to claim 2, wherein the admission of the addition gas and/or the discharge of the shaft furnace gas is modulated such that the addition gas pressure, addition gas volumetric flow, discharge gas pressure and/or discharge gas volumetric flow are varied over a time span of less than or equal to 1 second.

18. The method according to claim 3, wherein the ratio of the distance (d) between the at least one lower admission opening and the at least one addition opening and the height (h) between the at least one lower admission opening and an upper outlet opening of the shaft furnace is from about 0.5 to about 1.0.

19. The method according to claim 4, wherein modulation of the treatment gas, modulation of the addition gas, and/or modulation of the shaft furnace gas is conducted in a manner selected from the group consisting of quasi-periodically, periodically, and harmonically for a period of time of from about 0.7 seconds to about 5 seconds.

20. The method according to claim 5, wherein modulation of the treatment gas, modulation of the addition gas, and/or modulation of the shaft furnace gas is conducted in a pulsating manner at a pulse width (a) of from about 35 milliseconds to about 55 milliseconds.

21. The method according to claim 6, wherein the treatment gas pressure, addition gas pressure, shaft furnace gas pressure, treatment gas volumetric flow, addition gas volumetric flow, and/or shaft furnace gas volumetric flow are varied such that within the shaft furnace there is a superimposed oscillation having a phase difference $\phi$ of $0\pm/90$.

22. The shaft furnace according to claim 9, wherein the controller is set in such a manner that the treatment gas pressure and/or treatment gas volumetric flow are subjected to a variation over a span of time of less than or equal to 20 seconds.

23. The shaft furnace according to claim 10, wherein the ratio of d:h is from about 0.5 to about 1.0.

24. The method of claim 1, wherein the method affirmatively requires the operation (a).

25. The method of claim 1, wherein the method affirmatively requires the operation (b).

26. The method of claim 1, wherein the method affirmatively requires operations (a) and (b).

27. The furnace of claim 9, wherein the furnace affirmatively requires the component (a).

28. The furnace of claim 9, wherein the furnace affirmatively requires the component (b).

29. The furnace of claim 9, wherein the furnace affirmatively requires components (a) and (b).

* * * * *